US006028396A

United States Patent [19]

Morrissey, Jr. et al.

[11] Patent Number: 6,028,396

[45] Date of Patent: Feb. 22, 2000

[54] LUMINAIRE DIAGNOSTIC SYSTEM

[75] Inventors: Joseph F. Morrissey, Jr., Rockland; Jeff Walters, Marshfield, both of Mass.; Lucinda Seigel, San Francisco, Calif.

[73] Assignee: Dark to Light, Pembroke, Mass.

[21] Appl. No.: 08/914,661

[22] Filed: Aug. 19, 1997

[51] Int. Cl.[7] ..... H05B 37/00

[52] U.S. Cl. ..... 315/119; 315/151; 315/307; 315/308

[58] Field of Search ..... 315/119, 150, 315/307, 291, 308, 151

[56] References Cited

U.S. PATENT DOCUMENTS

| | | | |
|---|---|---|---|
| 4,207,500 | 6/1980 | Duve et al. | 315/119 |
| 4,473,779 | 9/1984 | Lindner et al. | 315/119 |
| 5,235,252 | 8/1993 | Blake | 315/151 |
| 5,650,694 | 7/1997 | Jayaraman et al. | 315/119 |
| 5,751,115 | 5/1998 | Jayaraman et al. | 315/DIG. 5 |

OTHER PUBLICATIONS

Frederick H. Blake, Data Brief—Anti–Cycling, High Pressure Sodium Street Light Integrated Design Luminaire, Feb. 1, 1997.

*Primary Examiner*—David H. Vu
*Assistant Examiner*—Wilson Lee
*Attorney, Agent, or Firm*—Iandiorio & Teska

[57] ABSTRACT

A luminaire diagnostic system including a lamp and a photocontroller for automatically turning the lamp on during periods of darkness and off during periods of daylight wherein the photocontroller includes detector circuitry for detecting the load drawn by the lamp, a microprocessor, responsive to detected load and programmed to predict a condition of the lamp such as a cycling event and/or lamp out condition based on the load drawn by the lamp, and an indicator such as a visual alarm for indicating the occurrence of the condition detected and/or a transmitter for transmitting the detected condition to a remote location. Also, upon cycle detection, the lamp may be turned off to prevent damage to fixture components.

13 Claims, 5 Drawing Sheets

CYCLING DETECTION

LUMINAIRE DIAGNOSTIC SYSTEM

FIELD OF INVENTION

This invention relates to a luminaire diagnostic system which, inter alia, includes means for sensing whether the lamp is out and/or cycling and which also provides an indication of such a condition by transmitting information about the condition to a remote base station and/or illuminating a signal light on the photocontroller.

BACKGROUND OF INVENTION

Since the cost of servicing a luminaire such as a single street light can cost $100 or more on busy roads, and in busy areas, and since there are 60,000,000 street lights in the United States alone, the problem of high pressure sodium (HPS) street lights cycling at the end of their useful life is severe. The phenomena of cycling of HPS lamps as they age from use is caused by some of the electrode material being plated off the electrodes and then being deposited on the inside of the arc tube. This makes the tube darken and traps more heat inside the arc tube. As a result, an increased voltage is required to keep the lamp ignited or ionized. When the voltage limit of the ballast is reached, the lamp extinguishes by ceasing to ionize. Then, the lamp must cool down for several minutes before an attempt at re-ignition can be made. The result is "cycling" wherein the worn out lamp keeps trying to stay lighted. The voltage limit is reached, the lamp extinguishes, and then after an approximately one-two minute cool down period, the arc tube re-ignites and the light output increases again and until the voltage limit is reached whereupon the lamp again extinguishes. This repetitive on/off cycle is called cycling.

Cycling may waste electricity, cause RFI (radio frequency interference) which adversely effects communication circuits, radios, and televisions in the area, and may adversely effect and prematurely wear out the ballast, starter, and photocontroller.

For example, if an HPS lamp undergoes cycling for a few nights before it is finally serviced and replaced, the ballast or starter can be damaged or degraded. But, when the HPS lamp is replaced, this damage or degradation might not be detected. Later service calls then must be made to service these problems. The ballast and starter components are more expensive than the lamp or the photocontroller.

The cycling problem is well documented but so far the only solutions offered are to replace the HPS lamps with less efficient mercury lamps or to reconfigure existing photocontrollers with a special fiber optic sensor which senses light from the lamp and sends a signal to a microprocessor to indicate whether the lamp is on or off. After three on/off cycles, the microprocessor turns the lamp off and turns on a red strobe light which can be seen from the street. Unfortunately, this prior art solution requires modifications to the existing light fixture (e.g. a hole must be drilled in the fixture housing) and the use of an expensive fiber optic sensor.

Another problem with all luminaires including HPS or other types of lamps is the cost involved in correcting the cycling problem and other faults such as a lamp out condition. For example, a resident may report a lamp out or a cycling condition but when the repair personnel arrives several hours later, the lamp may have cycled back on. Considering the fact that the lamp pole may be 25–35 ft. high, repair personnel can waste a considerable amount of time checking each lamp in the area. Also, repair and maintenance personnel may not be able to service a given residential area until daylight hours when all of the street lights are off by design.

SUMMARY OF INVENTION I

It is therefore an object of this invention to provide a luminaire diagnostic system.

It is a further object of this invention to provide a method of monitoring luminaires such as street lights.

It is a further object of this invention to provide such a system and method which, because of its ability to detect cycling, saves electricity, reduces RFI, and prevents the premature failure of ballasts and starters associated with luminaries.

It is a further object of this invention to provide such a system and method which significantly reduces the cost of servicing and repairing luminaires such as street lights.

It is a further object of this invention to provide such a system and method which can be implemented in a cost effective way without the need for making complicated modifications to existing luminaires and/or the use of expensive fiber optic sensors.

It is a further object of this invention to provide such a system and such a method which provides a positive indication of a cycling or lamp off condition in real time.

This invention results from the realization that cycling of a street light and other faulty conditions such as a lamp out condition can be detected by monitoring the load drawn by the lamp at different times and then comparing the load differences to predetermined thresholds, that such detection can be accomplished by an inexpensive transformer added to the photocontroller circuitry and coupled to a specially programmed microprocessor, and that a transmitter can be linked to the microprocessor to transmit lamp out, lamp cycling, and other fault conditions to a location remote from the street lamp to initiate repair/maintenance services in real time. Alternatively, the microprocessor can illuminate one or a series of LEDs resident on the photocontroller to provide repair personnel with a positive indication regarding the condition of the lamp even in the daylight hours when the lamp is purposefully turned off. Further, the controller can shut the lamp off after a predetermined number of cycles. This feature eliminates ballast and starter degradation.

This invention features a luminaire diagnostic system comprising a lamp and a photocontroller for automatically turning the lamp on during periods of darkness and off during periods of daylight. The photocontroller includes means for detecting a load drawn by the lamp, a microprocessor, responsive to the means for detecting and programmed to predict a condition of the lamp based on the load drawn by the lamp, and means, responsive to the microprocessor, for indicating the occurrence of the condition detected.

The microprocessor preferably includes a first routine which reads the load shortly after the lamp is turned on and then again after a predetermined time, calculates the load difference, and determines whether the load differences exceeds a predetermined threshold. The microprocessor also preferably includes a second routine which calculates whether the load difference at predetermined times exceeds a predetermined threshold, and counts the number of times the load difference exceeds that predetermined threshold.

The means for indicating may include a visual alarm and/or a transmitter for transmitting the detected condition to a location remote from the photocontroller.

The means for detecting typically includes a transformer, a current rectifier responsive to the transformer, a filtering capacitor responsive to the transformer, and a voltage limiter responsive to the transformer for protecting the microprocessor.

The diagnostic system need not be a component of the photocontroller. Thus, the luminaire diagnostic system of this invention may include means for sensing a condition of the luminaire and means for providing an indication of the sensed conditioned.

One such condition is that a lamp is out. In that case, the means for sensing preferably includes means for detecting the load on the lamp at two different times and means for predicting a condition of the lamp based on the load drawn by lamp including means for calculating whether the load difference exceeds a predetermined threshold. One such time is preferably proximate the time the lamp is turned on. The predetermined threshold is usually greater than zero to accommodate loads drawn by a capacitor. The means for detecting preferably includes a transformer and the means for predicting includes a microprocessor responsive to the transformer and programmed to calculate the differences in the detected load.

Another condition may be that the lamp is cycling. In that case, the means for sensing includes means for detecting the load on the lamp at two different times and means for predicting a condition of the lamp based on the load drawn by the lamp including means for calculating whether the load difference exceeds a predetermined threshold, means for counting the number of times the load difference exceeds a predetermined threshold, and means for counting the number of times the load difference exceeds that predetermined threshold.

The means for providing an indication includes one light which is illuminated when the count exceeds a predetermined count threshold and another light which is illuminated when the load difference exceeds the predetermined threshold. As an alternate one LED lamp can be used in the flashing mode to indicate cycling or steady mode to indicate lamp out.

In the preferred embodiment, the means for sensing includes both means for determining whether the lamp is out and means for determining whether the lamp is cycling. The means for providing an indication may include a visual alarm proximate the luminaire, and/or a transmitter for transmitting a sensed condition to a location remote from the luminaire.

This invention also features a method of diagnosing a condition of a luminaire including a lamp, the method comprising the steps of detecting a load drawn by the lamp; predicting a condition of the lamp based on the load drawn by the lamp; and indicating the occurrence of the condition detected. The step of predicting includes implementing a first routine which reads the load shortly after the lamp is turned on and then again after a predetermined time, calculates the load difference, and determines whether the load difference exceeds a predetermined threshold. The method also preferably includes implementing a second routine which calculates whether the load difference at predetermined times exceeds a predetermined threshold, and which counts the number of times the load difference exceeds that predetermined threshold. The step of indicating includes activating a visual alarm and/or transmitting a detected condition to a remote location.

The luminaire diagnostic method of this invention comprises sensing a condition of the luminaire and providing an indication of the sensed condition. One condition is that a lamp is out. In that case, the step of sensing includes detecting the load on the lamp at two different times and calculating whether the load difference exceeds a predetermined threshold. The first time is typically when the lamp is turned on. The second time is 3 minutes after the lamp is turned on. The predetermined threshold is preferably greater than zero to accommodate a load drawn by a capacitor.

Another condition is that the lamp is cycling. In that case, the step of sensing includes detecting a load on the lamp at two different times, calculating whether the load difference exceeds a predetermined threshold and counting the number of times the load difference exceeds the predetermined threshold.

The step of providing an indication includes activating a visual alarm proximate the luminaire and/or transmitting a sensed condition to a location remote from the luminaire.

DISCLOSURE OF PREFERRED EMBODIMENT

Other objects, features and advantages will occur to those skilled in the art from the following description of a preferred embodiment and the accompanying drawings, in which.

Figure 1:
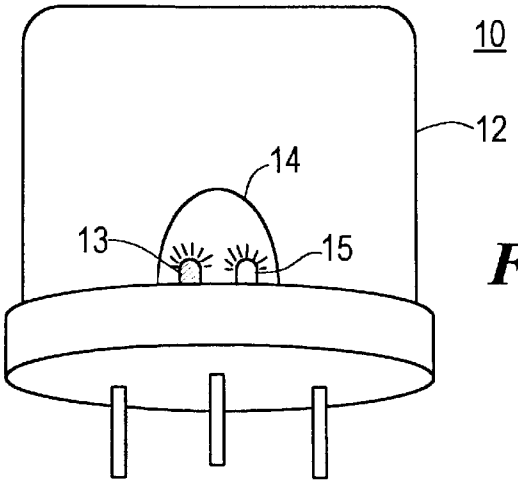
FIG. 1 is a schematic view of a photocontroller including the luminaire diagnostic system of this invention.

Photocontrol device 10, FIG. 1, includes thermoplastic, high impact resistant, ultraviolet stabilized polypropylene cover 12 and clear window 14 made from UV stabilized, UV absorbing, acrylic for the light sensor which resides on a circuit board within cover 12. Photocontrol device 10 is typically configured to fit an ANSI C136. 10 receptacle but may be mounted in an ANSI C136.24 "button" package or other enclosure.

Figure 2:
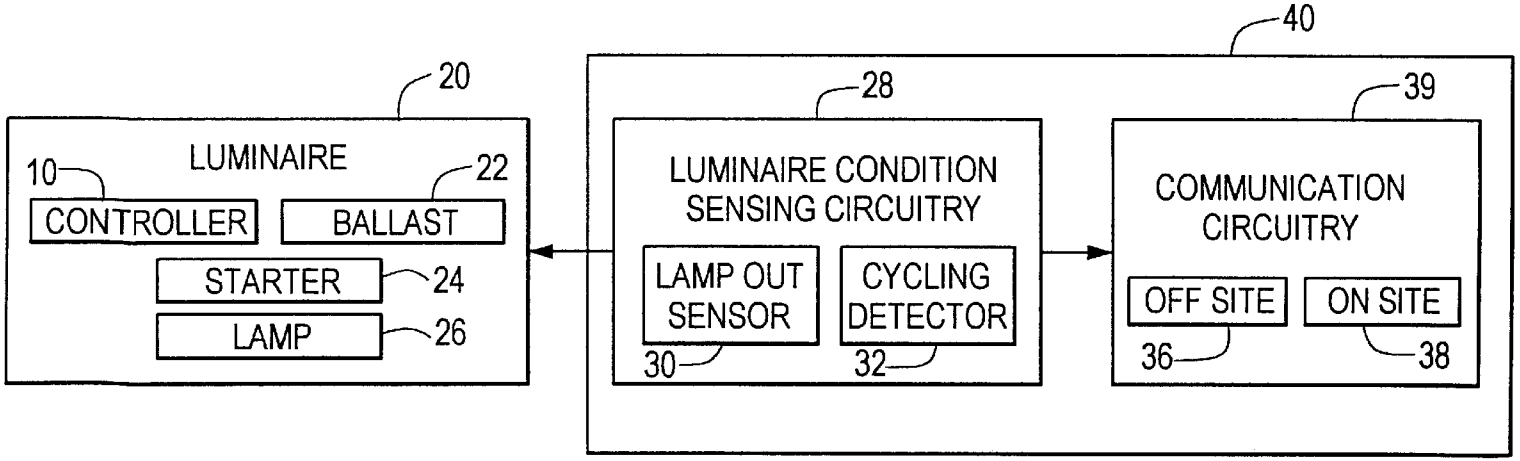
FIG. 2 is a block diagram of the primary components of the luminaire diagnostic system of this invention.
Figure 3:
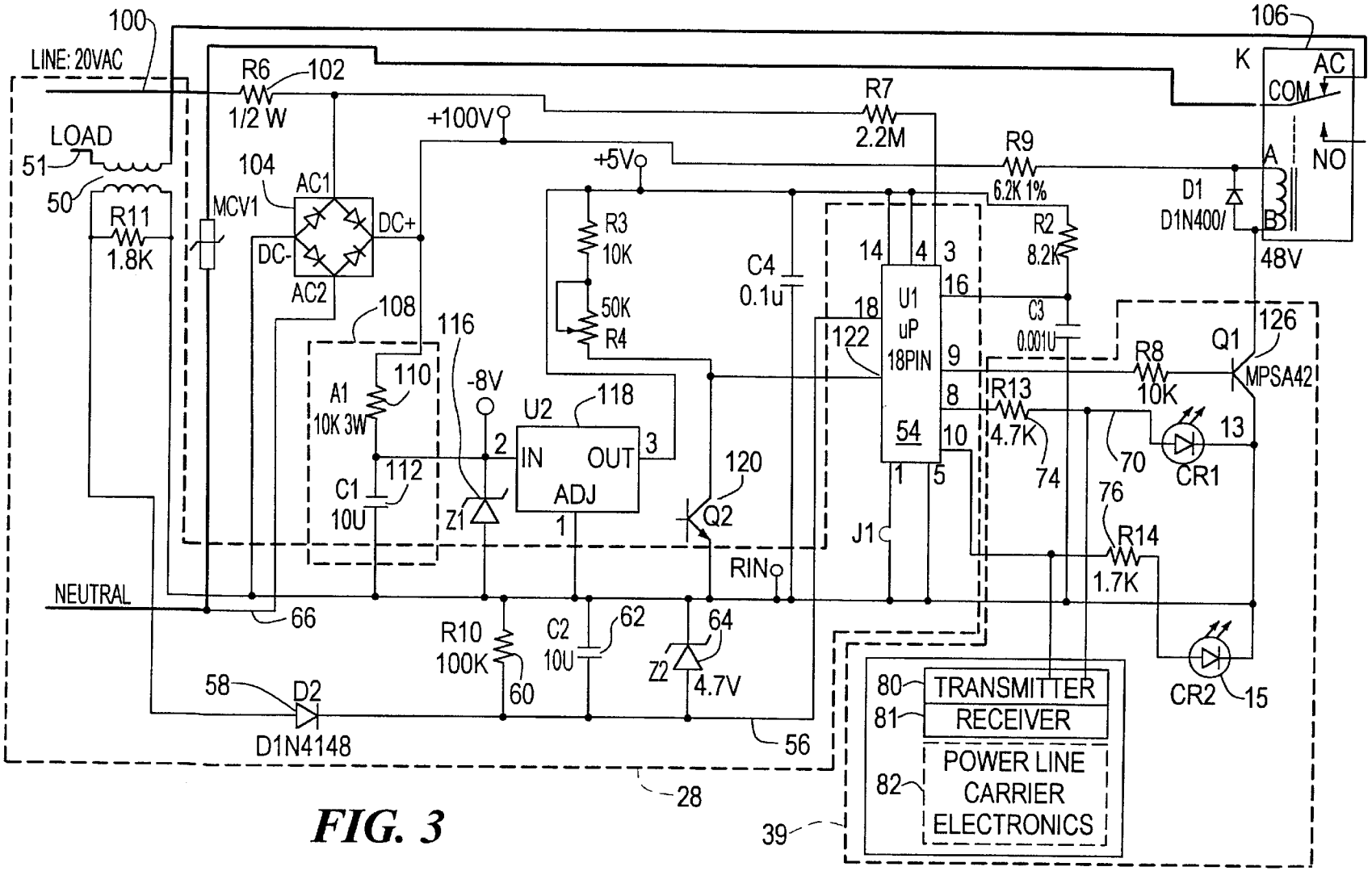
FIG. 3 is a wiring diagram showing the primary components of the luminaire diagnostic system of this invention.
Figure 7:
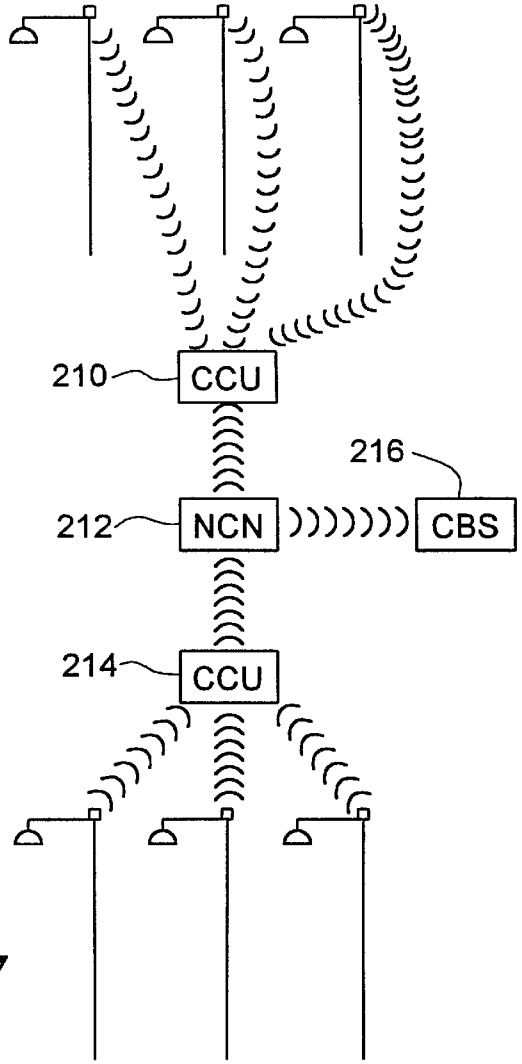
FIG. 7 is a schematic view showing another method of externally transmitting luminaire fault conditions in accordance with the subject invention.

The circuit board within cover 12 is configured to operate in accordance with the block diagram shown in FIG. 2 and the specific circuit diagram shown in FIG. 3. Microcontroller 54 shown in the circuit diagram of FIG. 3 is programmed in accordance with the flow charts shown in FIGS. 4 and 5 in accordance with this invention, and transmitter 80 shown in the circuit diagram of FIG. 3 can be linked to a communications network or networks as shown in FIGS. 6 and 7 in accordance with this invention.

A standard street light type luminaire 20, FIG. 2, typically includes a controller such as controller 10, FIG. 1, ballast 22, starter or igniter 24, and HPS or other type of lamp 26.

Luminaire condition sensing circuitry 28 in accordance with this invention may be integral with photocontroller 10, FIG. 1 and includes lamp out sensor circuitry 30 and cycling detector circuitry 32. In the preferred embodiment, lamp out sensor circuitry 30 and cycling detector circuitry 32 uniquely share the same electronic components discussed with reference to FIG. 3. Thus, there are means for sensing a condition of luminaire 20 such as a lamp out condition or a cycling condition, namely luminaire condition sensing circuitry 28. Also a part of the present invention is communication circuitry 34 which may include off-site remote communications subsystem 36 and/or on-site communications subsystem 38 which may simply be LED 13, FIG. 1 of one color for indicating the occurrence of a cycling condition and LED 15 of another color for indicating the occurrence of a lamp out condition. The LED's may also be made to flash to indicate cycling and be steady on to indicate a lamp out condition. Off-site communication circuitry 36 may also be implemented to transmit these and other conditions to remote location for real time diagnostics.

Thus, luminaire diagnostic system 40 which includes condition sensing circuitry 28 and communication circuitry 34 eliminates the guess work involved, especially in the day time, when repair personnel attempt to determine which street light has a faulty component. The cost of servicing street lights is severely reduced in part because the guess work of on-site diagnosing of problems with the street light system are eliminated.

Luminaire condition sensing circuitry 28, FIG. 3, includes means for detecting the load drawn by the lamp such as transformer 50 coupled to load line 51 and connected to microprocessor 54 via line 56. Microprocessor 54 predicts a lamp out and/or lamp cycling condition in accordance with programming described with reference to FIGS. 4 and 5. Diode 58 is located on line 56 to rectify the current from transformer 50. Resistor 60, capacitor 62, and Zener diode 64 are connected across line 56 and neutral line 66 to filter and stabilize the current. Capacitor 62 filters the rectified AC current present on line 56 and typically has a value of 10 $\mu$F. Resistor 60 has a typical value of 100 kΩ and acts as a bleeder for capacitor 62. Zener diode 64 acts to limit the voltage to microprocessor 54 and has a typical value of 4.7 volts at one watt. Microprocessor 54 then provides signals over lines 70 and 72 through resistors 74 and 76 which limit the current output current (typical values are 4.7 kΩ) to LEDs 13 and 15, respectively.

Alternatively, or in addition, transmitter 80 may be connected to microprocessor 54 and used to transmit signals indicative of conditions sensed by sensing circuitry 28 to a remote location as discussed infra via RF communications. Alternatively, such communication signals may be placed back on the power line to which the lamp is connected via power line carrier electronics package 82. Microprocessor 54 is preferably an 18 pin microprocessor part no. PIC16C710 with an analog to digital converter capability available from Microchip. Much of the remainder of the circuitry shown in FIG. 3 is described in general in U.S. Pat. No. 5,195,016 incorporated herein by this reference. Specifically, 120 volt AC line 100 is fed to resistor 102 (1 kΩ) which is used to limit the current to bridge rectifier 104. Bridge rectifier 104 rectifies the AC current to a rippled 100 VDC presented to relay 106 and resistor/capacitor filter network 108. Resistor 110 has a typical value of 10 kΩ and capacitor 112 has a typical value of 10 $\mu$F. RC filter network 108 filters the rippled DC signal to a smooth DC signal and Zener diode 116 clamps the voltage at 8 volts DC. Regulator 118 receives this 8 volt VDC signal and maintains a constant 5 volt DC signal to microprocessor 54. When light is sensed by photocell 120, the voltage level on pin 1, 122 of microprocessor 54 will vary inversely with the light level. When the light level is high (daylight) the voltage is low and when the light level is low (night time) the voltage is high. Program variables in the programming of microprocessor 54 make it possible to select what light level will turn on switch 126 which in turn energizes relay 106 and also the light level which will turn off switch 126 which in turn de-energizes relay 106.

Figure 4:
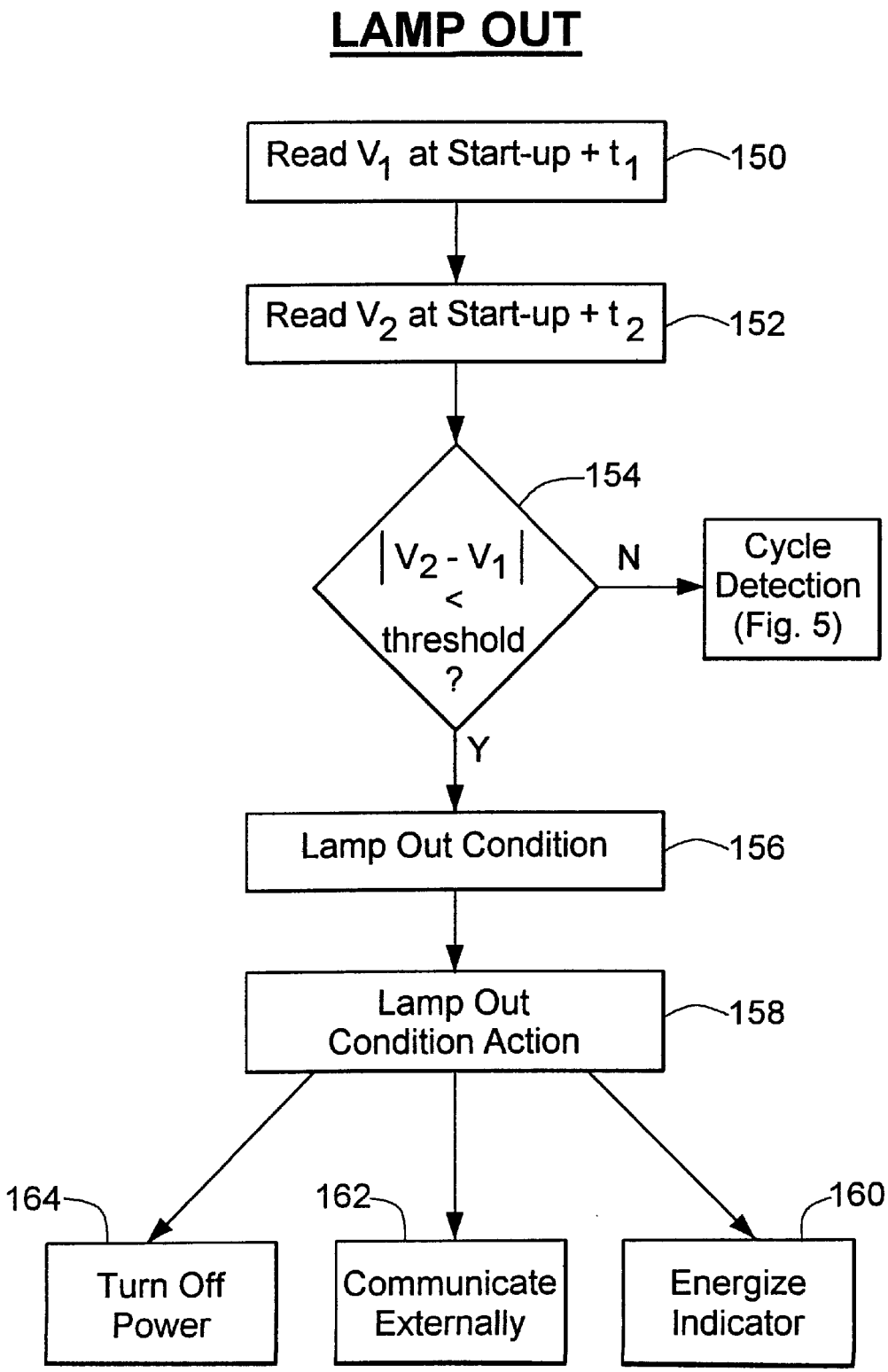
FIG. 4 is a flow chart depicting the routine for detecting a lamp out condition in accordance with this invention.
Figure 5:
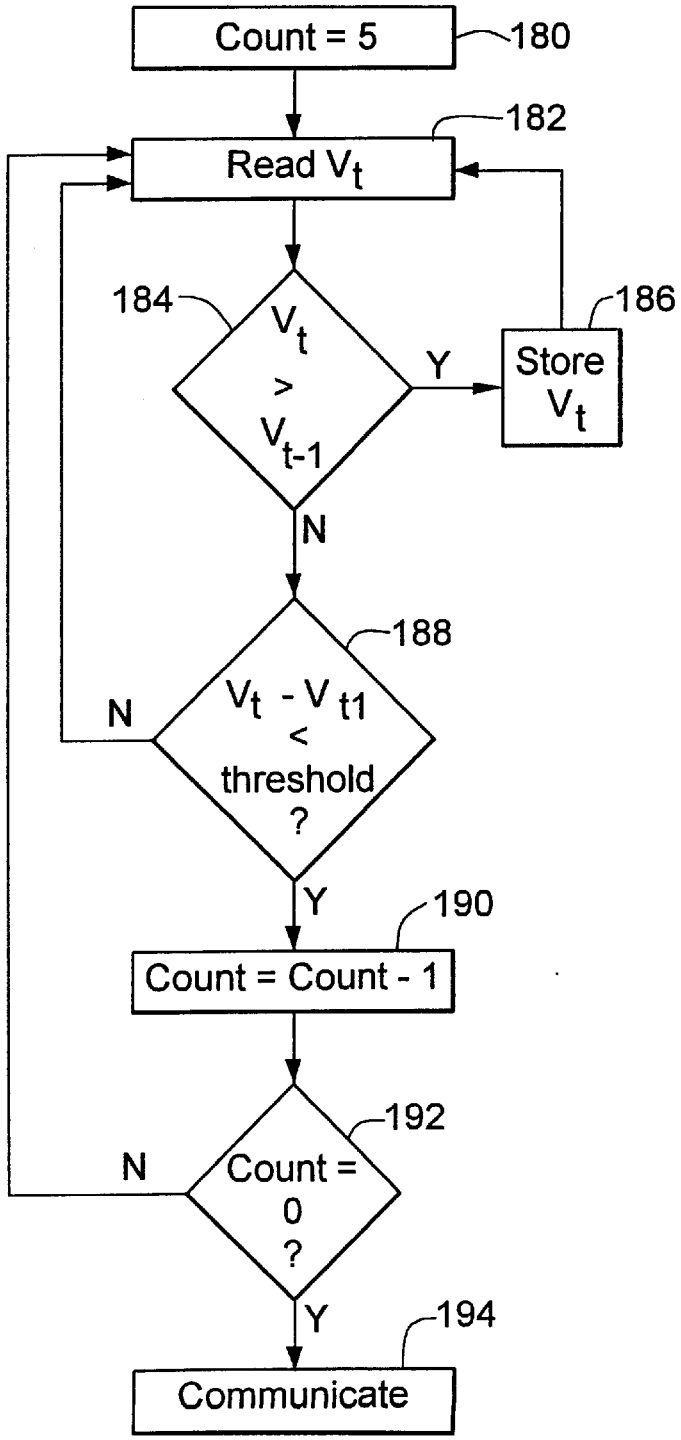
FIG. 5 is a flow chart depicting the routine for detecting cycling in accordance with this invention.
Figure 6:
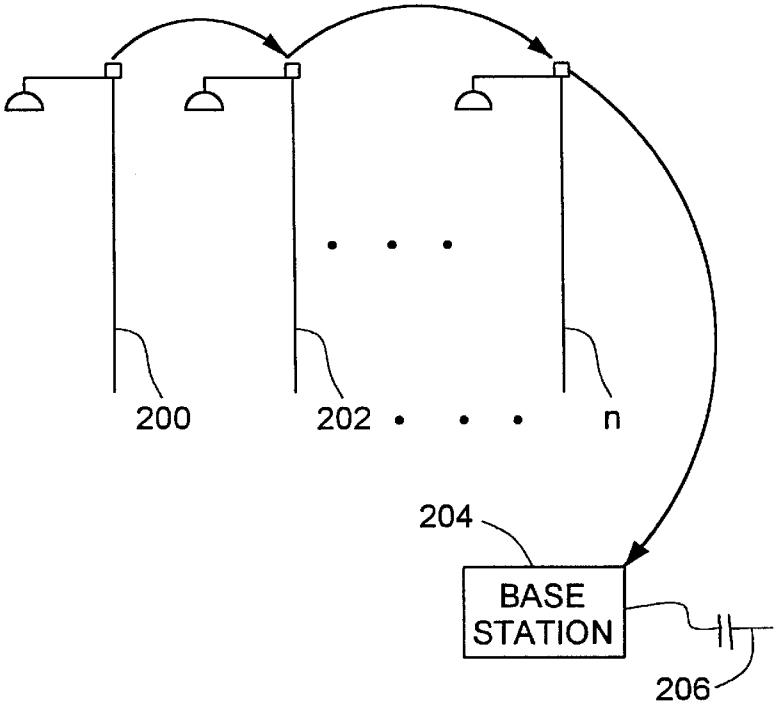
FIG. 6 is a schematic view showing one method of externally transmitting luminaire fault conditions diagnosed in accordance with this invention.

In accordance with this invention, microprocessor 54, FIG. 3, is also programmed in accordance with the flow charts shown is FIGS. 4 and 5. A first routine, called a lamp out detection routine, begins by reading the voltage level on line 56, FIG. 3 at some time $t_1$ after the lamp is first turned on, step 150, FIG. 4. $t_1$ is typically about 2 seconds which is sufficient time to eliminate any transients in the circuitry. At some time later, $t_2$, typically 3 minutes, the voltage is again read, step 152, and these two voltages are compared to determine whether they are lower than a preset threshold, step 154, typically about 12.5 percent. If the difference between the two different voltage level readings is greater than this threshold, processing transfers to the cycle detection mode discussed with reference to FIG. 5. If, however, on the other hand, the difference between the two different voltage readings is less than this threshold, this is indicative of a lamp out condition, step 156.

In other words, a properly working lamp consistently draws more and more of a load during the start up mode while a failed lamp or ballast does not. The threshold level for the comparison at step 154 could be zero but the 12.5 percent level is preferably used because the power correction capacitor used in the luminaire often draws a load even when the lamp is out but it always draws a constant load over time. Once microprocessor 54, FIG. 3, determines a lamp out condition, step 156, FIG. 4, it can take any number of lamp out condition actions, step 158, such as energizing LED 15, FIGS. 1 and 3, step 160, FIG. 4, provide a signal to transmitter 80, FIG. 3 to communicate to a remote base station, step 162, FIG. 4, and/or turning the power off to the lamp, step 164, to save energy and the life of the starting aid and ballast. Receiver 81 may be used as a means to activate certain routines programmed in microprocessor 54, FIG. 3 including a routine to power the lamp in daylight hours for daytime testing.

Microprocessor 54, FIG. 3, also includes the cycling detection routine shown in FIG. 5 wherein the count representing the number of cycles is set to a number such as 5 upon initialization, step 180, and then the voltage on line 56, FIG. 3, is read periodically at a time t such as every second, step 182. If a subsequent voltage reading is greater than a previous voltage reading, step 184, the subsequent voltage reading is stored and used as the base line, step 186. This voltage level is stored in a buffer as a bench mark so that any transients and any voltage levels read during the warm up period will be accounted for. Processing then continues until a subsequent voltage reading is lower than a previous voltage reading, step 188, by some predetermined threshold, for example, 25% which indicates the presence of a cycling event. The 25% threshold could be as low as 12%, but a 12% variation could also be indicative of a power surge and so the 25% threshold is preferred. The count is then decremented, step 190, and once the count reaches some predetermined minimum, step 192, for example, 0, the fact that a cycling event has occurred is communicated, step 194, in a fashion similar to the actions taken after step 158, FIG. 4. The lamp can be turned off permanently or the microprocessor can be programmed to turn the lamp off only for one night and then reset to again detect cycling the next night to prevent erroneous cycling detection events. In addition, or alternatively, LEDs 13 or 15, FIG. 1 can be made to flash, and/or a signal can be sent via transmitter 80 to a remote location to indicate the occurrence of a cycling event.

External communications may occur via RF transmission or via powerline carrier technology as shown in FIG. 6 from street light 200 to street light 202 to street light$_n$ whereupon the condition information is sent to final or intermediate base station 204 and, if required, to other base stations or other locations as shown at 206 in any number of ways including satellite transmission, RF transmissions, land line transmissions, and the like. Alternatively, as shown in FIG. 7, a communication network utilizing RF transmitters and/or transmitter receivers can be used wherein one set of transmitters resident on the photocontrollers described above transmit to communication control unit 210 which in turn communicates to network control node 212 which also receives communications from communication control unit 214. Network control node 212 then communicates with central base station 216 as is known in the art of remote meter reading technology.

Note, however, that in one embodiment, such remote communication capabilities are not required and LEDs 13 and 15, FIGS. 1 and 3, can be the only indicators in an less expensive, less complex photocontroller in accordance with the subject invention. Note also that other types of visual and even non-visual alarm indicators could be used instead of LEDs 13 and 15.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A luminaire diagnostic system comprising:

a lamp; and a photocontroller for automatically turning said lamp on during periods of darkness and off during periods of daylight, said photocontroller including:

means for detecting a load drawn by said lamp, a microprocessor, responsive to said means for detecting and programmed to predict a condition of the lamp based on the load drawn by the lamp, said microprocessor including a first routine which:

reads the load shortly after the lamp is turned on and then again after a predetermined time, calculates the load difference, and determines whether the load difference exceeds a predetermined threshold, and means, responsive to said microprocessor, for indicating the occurrence of the condition detected.

2. A luminaire diagnostic system comprising:

a lamp; and a photocontroller for automatically turning said lamp on during periods of darkness and off during periods of daylight, said photocontroller including:

means for detecting a load drawn by said lamp, a microprocessor, responsive to said means for detecting and programmed to predict a condition of the lamp based on the load drawn by the lamp, said microprocessor including a routine which:

calculates whether the load difference at predetermined times exceeds a predetermined threshold, and counts the number of times the load difference exceeds said predetermined threshold; and means, responsive to said microprocessor, for indicating the occurrence of the condition detected.

3. A luminaire diagnostic system comprising:

a lamp; and a photocontroller for automatically turning said lamp on during periods of darkness and off during periods of daylight, said photocontroller including:

means for detecting a load drawn by said lamp, a microprocessor, responsive to said means for detecting and programmed to predict a condition of the lamp based on the load drawn by the lamp, said microprocessor including:

a first routine which:

reads the load shortly after the lamp is turned on and then again after a predetermined time, calculates the load difference, and determines whether the load difference exceeds a predetermined threshold; and a second routine which:

calculates whether the load difference at predetermined times exceeds a predetermined threshold, and counts the number of times the load difference exceeds said predetermined threshold, and means, responsive to said microprocessor, for indicating the occurrence of the condition detected.

4. A luminaire diagnostic system comprising:

means for sensing a condition of the luminaire; and means for providing an indication of the sensed condition, wherein said condition is that a lamp is out, the means for sensing including means for detecting the load on the lamp at two different times, one time proximate the time the lamp is turned on, and means for predicting a condition of the lamp based on the load drawn by the lamp including means for calculating whether the load difference exceeds a predetermined threshold.

5. A luminaire diagnostic system comprising:

means for sensing a condition of the luminaire; and means for providing an indication of the sensed condition, wherein said condition is that a lamp is out, the means for sensing including means for detecting the load on the lamp at two different times and means for predicting a condition of the lamp based on the load drawn by the lamp including means for calculating whether the load difference exceeds a predetermined threshold which is greater than zero to accommodate loads drawn by a capacitor.

6. A luminaries diagnostic system comprising:

means for sensing a condition of the luminaries; and means for providing an indication of the sensed condition, wherein said condition is that a lamp is out, the means for sensing including means for detecting the load on the lamp at two different times and means for predicting a condition of the lamp based on the load drawn by the lamp including means for calculating whether the load difference exceeds a predetermined threshold, said means for providing an indication including a light which is illuminated when the load difference does not exceed said predetermined threshold.

7. A luminaries diagnostic system comprising:

means for sensing a condition of the luminaries; and means for providing an indication of the sensed condition, wherein said condition is that a lamp is cycling, the means for sensing including means for detecting a load on the lamp at two different times and means for predicting a condition of the lamp based on the load drawn by the lamp including means for calculating whether the load difference exceeds a predetermined threshold and means for counting the number of times the load difference exceeds said predetermined threshold, said means for providing an indication including a light which is illuminated when the count exceeds a predetermined count threshold.

8. A method of diagnosing a condition of a luminaire including a lamp, the method comprising:

detecting a load drawn by the lamp;

predicting a condition of the lamp based on the load drawn by the lamp, said predicting including implementing a first routine which:

reads the load shortly after the lamp is turned on and then again after a predetermined time, calculates the load difference, and determines whether the load difference exceeds a predetermined threshold; and indicating the occurrence of the condition detected.

9. A method of diagnosing a condition of a luminaire including a lamp, the method comprising:

detecting a load drawn by the lamp;

predicting a condition of the lamp based on the load drawn by the lamp, said predicting including implementing a routine which:

calculates whether the load difference at predetermined times exceeds a predetermined threshold, and counts the number of times the load difference exceeds said predetermined threshold; and indicating the occurrence of the condition detected.

10. A method of diagnosing a condition of a luminaire including a lamp, the method comprising:

detecting a load drawn by the lamp;

predicting a condition of the lamp based on the load drawn by the lamp, said predicting including:

implementing a first routine which:

reads the load shortly after the lamp is turned on and then again after a predetermined time, calculates the load difference, and determines whether the load difference exceeds a predetermined threshold; and implementing a second routine which:

calculates whether the load difference at predetermined times exceeds a predetermined threshold, and counts the number of times the load difference exceeds said predetermined threshold; and indicating the occurrence of the condition detected.

11. A luminaries diagnostic method comprising:

sensing a condition of the luminaire; and providing an indication of the sensed condition, wherein said condition is that a lamp is out, the step of sensing including detecting the load on that lamp at two different times, one time proximate the time the lamp is turned on, and calculating whether the load difference exceeds a predetermined threshold.

12. A luminaries diagnostic method comprising:

sensing a condition of the luminaire; and providing an indication of the sensed condition, wherein said condition is that a lamp is out, the step of sensing including detecting the load on that lamp at two different times and calculating whether the load difference exceeds a predetermined threshold which is greater than zero to accommodate a load drawn by a capacitor.

13. A luminaries diagnostic method comprising:

sensing a condition of the luminaire; and providing an indication of the sensed condition including transmitting a sensed condition to a location remote from the luminaire, wherein said condition is that a lamp is out, the step of sensing including detecting the load on that lamp at two different times and calculating whether the load difference exceeds a predetermined threshold.

* * * * *